US006572967B1

(12) United States Patent
Abe et al.

(10) Patent No.: US 6,572,967 B1
(45) Date of Patent: Jun. 3, 2003

(54) POLY(TRIMETHYLENE TEREPHTHALATE) MULTIFILAMENT YARN

(75) Inventors: Takao Abe, Nobeoka (JP); Yoichiro Azuma, Nobeoka (JP); Tadashi Koyanagi, Nobeoka (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 10/088,746

(22) PCT Filed: Sep. 29, 2000

(86) PCT No.: PCT/JP00/06806

§ 371 (c)(1),
(2), (4) Date: Mar. 22, 2002

(87) PCT Pub. No.: WO01/23650

PCT Pub. Date: Apr. 5, 2001

(30) Foreign Application Priority Data

Sep. 30, 1999 (JP) ..... 11-280247

(51) Int. Cl.[7] ..... D01F 6/00; D01F 6/62

(52) U.S. Cl. ..... 428/364; 428/395; 264/130; 264/210.3; 264/211.14; 57/243

(58) Field of Search ..... 428/364, 395; 57/243; 764/130, 210.3, 211.14

(56) References Cited

U.S. PATENT DOCUMENTS 6,495,254 B1 * 12/2002 Abe et al. ..... 428/364

FOREIGN PATENT DOCUMENTS

| | | |
|---|---|---|
| JP | 52005320 | 1/1977 |
| JP | 52008123 | 1/1977 |
| JP | 58-104216 | 6/1983 |
| JP | 63-59412 | 3/1988 |
| JP | 08311177 | 11/1996 |
| JP | 11107081 | 4/1999 |
| JP | 11172536 | 6/1999 |
| JP | 11-200143 | 7/1999 |
| JP | 11302922 | 11/1999 |
| WO | WO96/00808 | 1/1996 |
| WO | WO00/22210 | 4/2000 |
| WO | WO00/55403 | 9/2000 |

* cited by examiner

*Primary Examiner*—N. Edwards
(74) *Attorney, Agent, or Firm*—Finnegan, Henderson, Farabow, Garrett & Dunner, L.L.P.

(57) ABSTRACT

The present invention provides a yarn suitable for stretch clothing, which yarn is a polytrimethylene terephthalte multifilamentary yarn having an intrinsic viscosity in a range from 0.7 to 1.1 dl/g, a single-filament size in a range from 3.3 to 8.9 dtex, an elongation at break in a range from 36 to 60% and the fluctuation value of yarn size (U %) is 1.2% or less and a false-twist textured yarn thereof. The multifilamentary yarn is produced under the conditions in that a distance between the adjacent spinning orifices is 5 mm or more, a spinning temperature is in a range from 255 to 275° C., a surface temperature of a spinneret is 255° C. or higher, and a product of a discharge linear speed V of molten polymer and the intrinsic viscosity [η] is in a range from 5 to 12 (m/min)(dl/g). Since the contamination on the periphery of the spinning orifice generating during the melt-spinning is minimized according to this production method, the wiping period can be prolonged which is extremely advantageous in the industrial sense.

7 Claims, 4 Drawing Sheets

POLY(TRIMETHYLENE TEREPHTHALATE) MULTIFILAMENT YARN

TECHNICAL FIELD

The present invention relates to a polytrimethylene terephthalate yarn suitable for clothing use, a false-twist textured yarn using the same and a method for producing the same. More specifically the present invention relates to a polytrimethylene terephthalate multifilamentary yarn suitable for a stretch clothing such as sportswear, innerwear or outerwear, a false-twist textured yarn using the same and an industrial method for continuously producing the same for a long time while maintaining a high quality.

BACKGROUND ART

A polyethylene terephthalate (hereinafter referred to as PET) fiber has been mass-produced around the world as a synthetic fiber most suitable for a clothing use and this has developed to a major industry.

On the other hand, a polytrimethylene terephthalate (hereinafter referred to as PTT) fiber has been known from prior arts such as those disclosed in (A) Japanese Unexamined Patent Publication Nos. 52-5320, (B) 52-8123, (C) 52-8124, (D) 58-104216, (E) J. Polymer Science; Polymer Physics Edition Vol. 14, pages 263 to 274 (1976), and (F) Chemical Fibers International Vol. 45 (April), pages 110 to 111 (1995). These prior arts, however, merely describe a basic property of, the PTT fiber and a basic method for producing the PTT fiber. That is, these prior arts have not matured to a level suitable for industrially producing PTT fiber, and the resultant PTT fiber also has not reached a quality level capable of industrially producing a knit or woven fabric.

For example, while the prior art (F) discloses that PTT fiber is characterized by a smaller Young's modulus (better in softness) and a higher stretch recovery (larger in elastic limit; more elastic) than PET fiber due to the solid structure of PTT polymer, designs of physical property and quality suitable for uses in which such characteristics are useful have not yet become apparent.

In the melt-spinning of polyester or nylon, if the spinning operation continues for a predetermined time, contaminant of decomposed polymer is adhered to the periphery of a spinning orifice. Such contamination is generally referred to as a white-eye phenomenon or an eye-mucus phenomenon. The contaminant is liable to disturb the smooth fiber formation and finally results in the breakage of multifilamentary yarn to disable the continuation of the spinning operation. To industrially avoid such a problem, it is usual to wipe off the contaminant from the surface of the spinneret at an constant period so that the smooth spinning state is maintained. Since the wiping operation must be carried out while interrupting the spinning, the wiping period is preferably longer, usually 24 hours or more on account of the working efficiency and the unit consumption of raw polymer.

Japanese Unexamined Patent Publication No. 11-200143 describes that PTT is more liable to deteriorate, due to heat or oxidation, than PET, whereby the deposition of the contaminant on the periphery of the spinning orifice becomes more significant during the spinning of PTT than PET and the wiping period must be shorter. To extend the wiping period, there are disclosed means for coating the surface of the spinneret with a lubricant of special composition and means for limiting a surface area A of polymer passing through a single orifice of the spinneret per unit time in a range from 5000 to 30000 $mm^2$/min. In this regard, A is defined by the following equation:

$$A(\mathrm{mm}^2/\mathrm{min})=(V\times M)/(\rho\times S)$$

wherein V is a discharge rate of polymer per single orifice (g/min), ρ is a density of polymer (g/$mm^3$), S is a cross-sectional area of an orifice ($mm^2$) and M is a peripheral length of an orifice (mm).

However, in this prior art, none of constituents of PTT multifilamentary yarn are most suitable for stretch clothing. Also, there is no description of the effect of an intrinsic viscosity of PTT on the wiping period, and an available wiping period is at most approximately 36 hours. Further, there is no suggestion of a range of A suitable (industrially favorable) for the respective single-fiber size.

Since an elastomeric fiber such as polyurethane fiber has appeared, stretch clothing has rapidly been developed in the field of sportswear, innerwear, pantyhose and outerwear. For example, there are a mixed knit clothing of polyurethane fiber with nylon fiber or PET fiber (for an innerwear) and pantyhose formed of a covering yarn in which polyurethane fiber is covered with nylon fiber or a knit or woven fabric formed of composite fibers (a latent crimp yarn) composed of polyurethane fiber and PET fiber.

However, these prior art products are insufficient because there is a limitation in characteristic or cost thereof. In view of the above-mentioned circumstances, various types of stretch clothing are desired and new synthetic fibers suitable for the stretch clothing are expected.

DISCLOSURE OF THE INVENTION

An object of the present invention is to provide a PTT multifilamentary yarn, composed of high-quality PTT fibers rich in softness and excellent in elasticity, which is suitable for a stretch clothing excellent in stretch-back property, and a method capable for producing the same at a high yield.

A high stretch-back property means a nature of rubber in which a proper elongation is obtained when the fiber or the fabric is stretched, together with the increasing resistant feeling as it is stretched, which elongation is promptly returned back to the original state when the stretching force is released. In the stretch clothing, a crimped yarn of synthetic fiber such as a false-twist textured yarn is usually used.

Another object of the present invention is to provide a false-twist textured yarn suitable for the stretch clothing.

To achieve the above objects, the present invention is defined as follows:

A first aspect of the present invention is a PTT multifilamentary yarn formed of single filaments, having a circular cross-section, of PTT composed of 95 mol % or more of trimethylene tetephthalate repeating units and 5 mol %, or less of other ester repeating units, characterized in that the PTT multifilamentary yarn satisfies the following conditions (1) to (4):

(1) An intrinsic viscosity in a range from 0.7 to 1.1 dl/g (2) A single-filament size in a range from 3.3 to 8.9 dtex (3) An elongation at break in a range from 36to 60%, and (4) A fluctuation value of yarn size (U %) of 1.2% or less A second aspect of the present invention is a half-drawn PTT multifilamentary yarn formed of single filaments, having a circular cross-section, of PTT composed of 95 mol % or more of trimethylene terephthalate repeating units and 5 mol % or less of other ester repeating units, characterized in that the PTT multifilamentary yarn satisfies the following conditions (1) to (4,):

(1) An intrinsic viscosity in a range from 0.7 to 1.1 dl/g (2) A single-filament-size in a range from 3.9 to 13.3 dtex (3) An elongation at break in a range from 61 to 120%, and (4) A fluctuation value of yarn size (U %) of 2% or less A third aspect of the present invention is a false-twist textured PTT yarn obtained by false-twisting or draw false-twisting the PTT multifilamentary yarn defined by the first aspect or the half-drawn PTT yarn defined by the second aspect.

A fourth aspect of the present invention is a method for producing a PTT multifilamentary yarn or half-drawn multifilamentary yarn formed of single filaments, having a circular cross-section and an intrinsic viscosity [η] in a range from 0.7 to 1.3 dl/g, of PTT composed of 95 mol % or more of trimethylene terephthalate repeating units and 5 mol % or less of other ester repeating units, characterized in that the PTT yarn is produced under the following conditions (1) to (4):

(1) The distances between centers of spinning orifices is 5 mm or more.

(2) The spinning temperature is in a range from 255 to 275° C.

(3) The surface temperature of a spinneret is 255° C. or higher.

(4) V×[η] is in a range from 5 to 12 (m/min)(dl/g) wherein V represents a linear discharge speed (m/min) of melted PTT.

BRIEF DESCRIPTION OF THE DRAWINGS

(FIG. 2 and FIG. 3 are shematic illustrations traced from digital images by digital camera.)

DETAILED DESCRIPTION OF THE INVENTION

Figure 1:
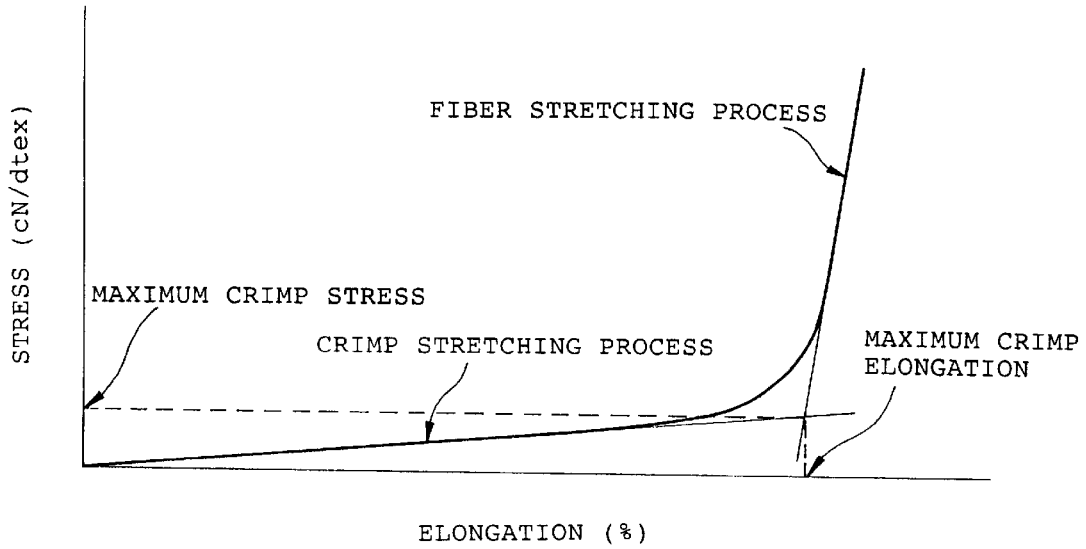
FIG. 1 illustrates one example of a stress-strain curve of a false-twist textured PTT yarn.

The present invention relates to a multifilamentary yarn formed of single filaments, having a circular cross-section, of PTT composed of 95 mol % or more of trimethylene terephthalate repeating-units and 5 mol % or less of other ester repeating units, a method for producing the same and a false-twist textured yarn using the same.

In the present invention, a term "multifilamentary yarn" includes continuous filaments including tow and staple fibers obtained by cutting the continuous filaments.

PTT in the present invention is composed of 95 mol % or more of trimethylene terephthalate repeating units and 5 mol % or less of other ester repeating units (the trimethylene terephthalate repeating unit is an ester unit generated from terephthalic acid and trimethylene glycol). That is, the PTT in the present invention include a PTT homo-polymer and a PTT copolymer containing other ester repeating units, of 5 mol % or less.

Examples of the coplolymerized component is as follows:

An acidic component includes aromatic dicarbonic, acid represented by isopthalic, acid or 5-sodium sulfoisophthalic acid and aliphatic dicarbonic acid represented by adipic acid or itaconic acid, and a glycolic component includes tetramethylene glycol, ethylene glycol, polyethylene glycol or others. Also, hydroxycarbonic acid such as hydroxybenzoic acid. A plurality of copolymerized components may be contained.

The PTT in the present invention may contain, as additives or as copolymerized components, a delusterant such as titanium oxide, an antioxidant, an antistatic agent, an ultraviolet screening agent, an antifungus agent or various pigments.

The PTT in the present invention may be produced by a known method in which, for example, the degree of polymerization is made to increase at two stages so that a certain intrinsic viscosity is first obtained through a melt-state polymerization, then a final intrinsic viscosity is obtained through a solid-phase polymerization.

The first aspect of the present invention will be described below.

In the first aspect of the present invention, the intrinsic viscosity of the PTT forming the multifilamentary yarn is in a range from 0.7 to 1.1 dl/g. In this regard, the intrinsic viscosity is measured by a method described later. If the intrinsic viscosity is less than 0.7 dl/g, the strength at break becomes as low as 3.1 cN/dtex or less, and in the extreme case as low as 2.6 cN/dtex or less which is unsuitable for a clothing use and improper for stretch clothing. Contrarily, if it exceeds 1.1 dl/g, the dimensional stability of the multifilamentary yarn against heat becomes worse and the production cost of the PTT used as a raw material is high. Preferably, the intrinsic viscosity is in a range from 0.8 to 1.1 dl/g, more preferably from 0.8 to 1.0 dl/g.

According to the first aspect, the single-filament size is in a range from 3.3 to 8.9 dtex. On account of stretch-back property, the single-filament size is preferably 3.3 dtex or more. Details of this point will be described below.

The stretch-back property is related to an elongation and a force in a stress-strain curve of a false-twist textured yarn shown in FIG. 1, in an initial process of which crimps of the false-twist textured yarn is stretched and in a final process of which filaments themselves are elongated. That is, the stretch-back property is a composite effect of the crimp-stretch characteristic and, the elasticity inherent to the PTT fiber. The resistant feeling during the crimp-stretching process is decided by the stretching stress of the crimps (corresponding to the effect of a spring constant in Hook's Law) and the elasticity of the fiber itself.

Since PTT has a higher crimp elongation and a larger stretch recovery in comparison with PET, it exhibits an excellent stretch-back property. Further, the stretch-back property is correlated to a crimp stretching stress, and is effective as the filament size becomes larger. If the filament size is less than 3.3 dtex, the elastic modulus becomes smaller in the process in which the crimps of the false-twist textured yarn is stretched (i.e., in the initial process described above), and as a result, the maximum crimp stress shown in FIG. 1 is too small to obtain the favorable stretch-back property.

Contrarily, if the filament size exceeds 8.9 dtex, the yarn is insufficiently cooled-during the melt-spinning process to result in the fluctuation value of yarn size (U %) exceeding 1.2% and the generation of much yarn breakage. Also, the resultant multifilamentary yarn and the false-twist textured yarn obtained therefrom become hard to the touch and are unsuitable for the clothing use.

According to the first aspect of the present invention, the elongation at break obtained from the measurement of the stress-strain curve is in a range from 36 to 60%. If the elongation at break is less than 36%, yarn breakage and fluff are often generated during the production of the multifilamentary yarn and in the false-twist texturing process thereof whereby normal production or treatment is impossible. Particularly, the stability of the false-twist texturing process largely relies on the elongation at break. When the yarn is heated at a heater temperature in a range from 150 to 180° C. in the false-twist texturing process, it has been found that the elongation at break of the PTT fiber quickly lowers at such a high temperature, whereby the yarn breakage increases to a large extent. Such a phenomenon is not observed in PET and peculiar is to PTT.

According to the present invention, to solve the yarn breakage in the false-twist texturing process, the 150° C. elongation is preferably maintained at 25% or higher, and to achieve this, it is necessary to keep the elongation at break at 36% or more. This fact was first found by the present inventors. Moreover, if the elongation at break is 40% or more, it is possible to maintain the 150° C. elongation at 30% or higher and achieve a more stable false-twist texturing process. If the elongation at break exceeds 60%, the drawn yarn becomes irregular in size, whereby the fluctuation value of yarn size (U %) deteriorates and uneven dyeing becomes conspicuous. The elongation at break is preferably in a range from 40 to 60%, more preferably from 45 to 55%.

In the first aspect of the present invention, the fluctuation value of yarn size (U %) is 1.2% or less. If U % exceeds 1.2%, the multifilamentary yarn and the false-twist textured yarn obtained therefrom are liable to be unevenly dyed. Particularly, since the restriction is tight when the textured yarn is used for a woven fabric and a warp knit fabric, it is significant that U % is 1.2% or less. The U % is preferably 1.0% or less In this regard, uneven dyeing is evaluated by the determination of dyeing grade described later, wherein a grade 6 or higher is acceptable. This corresponds to a U % of 1.2% or less.

According to the second aspect of the present invention, the intrinsic viscosity of the PTT is in a range from 0.7 to 1.1 dl/g for the same reason as described in the first aspect. The intrinsic viscosity is preferably in a range from 0.8 to 1.1 dl/g, more preferably from 0.8 to 1.0 dl/g.

In the second aspect, a filament size of the PTT multifilamentary yarn must be such that the filament size in a range from 3.3 to 8.9 dtex defined by the first aspect is obtained after being subjected to the draw false-twist texturing process (wherein a draw ratio is in a range from approximately 1.2 to 1.5 times). For this purpose, the filament size of the half-drawn yarn is in a range from 3.9 to 13.3 dtex. If the filament size is less than 3.9 dtex, that after being subjected to the draw false-twist texturing process becomes less than 3.3 dtex, and the favorable stretch-back property is not obtainable for the same reason as described in the first aspect of the present invention. Contrarily, if the filament size exceeds 13.3 dtex, the yarn is not sufficiently cooled in the melt-spinning process to generate much yarn breakage and, as well, may be unsuitable as a clothing fiber because of its hard touch. The filament size of the half-drawn yarn suitable for the stretch clothing is preferably in a range from 4.4 to 11.1 dtex.

In the second aspect, the elongation at break is in a range from 61 to 120%. If the elongation at break of the half-drawn multifilamentary yarn (POY) is less than 61%, a cheese-shaped package thereof is largely shrunk during the spinning and winding process to result in an abnormal package appearance, which makes the production thereof to be substantially impossible. The elongation at break is preferably in a range from 70to 120%.

In the second aspect, the fluctuation value of yarn size (U %) is 1.2%, or less. If the U % exceeds 1.2%, it not only causes uneven dyeing in the yarn itself but also causes uneven dyeing in a textured yarn thereof because an amplitude of the tension fluctuation increases during the draw false-twist textured process. Particularly, when the textured yarn is used for manufacturing a woven fabric or a warp, knit fabric, it is important that the U % is 1.2% or less because an allowable level of uneven dyeing is higher.

The third aspect of the present invention will be described below.

The false-twist textured PTT multifilamentary yarn according to the third aspect may be produced by processing the yarn of the first aspect or the half-drawn yarn of the second aspect through a false-twist texturing machine of a spindle type or a friction type, or through a draw false-twist texturing machine. The false-twist texturing yarn may be a double-heater type or a single-heater type.

The false-twist textured yarn according to the third aspect preferably has the maximum crimp elongation of 150% or more and the maximum crimp stress of 0.020 cN/dtex or more measured by a method described later. More preferably, the maximum crimp elongation of 160% or more and the maximum crimp stress of 0.25 cN/dtex.

The fourth aspect of the present invention will be described later.

Figure 2:
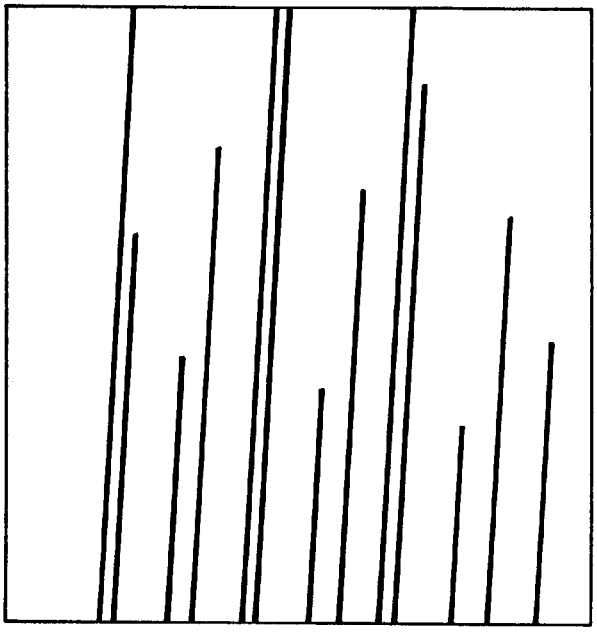
FIG. 2 illustrates one example of the periphery of a spinning orifice in which the white-eye phenomenon is not so significant.
Figure 3:
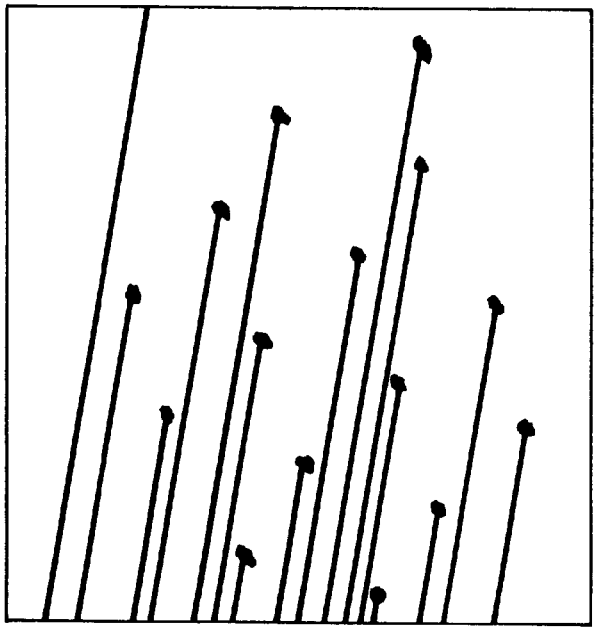
FIG. 3 illustrates-another example of the periphery of a spinning orifice in which the white-eye phenomenon is significant.

When the PTT is melt-spun, the adhesion of contaminant originated from polymer on the periphery of the spinning orifice (i.e., a white-eye phenomenon or an eye-mucus phenomenon; see FIGS. 2 and 3) is more significant than in PET. FIGS. 2 and 3 schematically illustrate the states in the vicinity of the spinning orifices, wherein in FIG. 2, the contamination in the vicinity of the spinning orifices is not so significant, while in FIG. 3, the contamination is significant. That is, it is apparent that more polymer is adhered to the spinning orifices in the case of FIG. 3 than in the case of FIG. 2. Such an white-eye phenomenon is particularly significant when a PTT yarn having a filament size of 3.3 dtex or more is spun. The fourth aspect is intended to solve this problem.

The fourth aspect is related to a multifilamentary yarn or half-drawn multifilamentary yarn formed of single filaments, having a circular cross-section and an intrinsic viscosity in a range from 0.7 to 1.3 dl/g, of PTT composed of 95 mol % or more of trimethylene terephthalate repeating units and 5 mol % or less of other ester repeating units.

In the fourth aspect, a distance between centers of spinning orifices is 5 mm or more. If the distance between centers of spinning orifices is less than 5 mm, the spun filament is unevenly cooled in the sense of time and space. Such a phenomenon is particularly significant when the filament size is 3.3 dtex or more. As a result, the fluctuation value of yarn size, (U %) exceeds 1.2% to deteriorate the dyeability of the resultant yarn. The distance between centers of spinning orifices preferably satisfies the following equation:

$$1.26\times d+0.8\ (\text{mm})\leqq \text{distance between centers of spinning orifices}\leqq 20\ (\text{mm})$$

wherein d represents the single-filament size (dtex) of the drawn yarn or the half-drawn yarn. If the distance between centers of spinning orifices exceeds 20 mm, no additional effect is obtained by the further extension of the distance, and conversely, the yarn breakage increases due to a dead space between the centers of the spinning orifices.

In the fourth aspect, the spinning temperature is in a range from 255 to 275° C. The spinning temperature is an internal temperature of a spin pack 5 (see FIG. 4) which is the same as that of molten PTT immediately before being spun.

Generally speaking, since PTT is more decomposable by heating or oxidation than PET, it is impossible, in the industrial sense, to adopt such a high spinning temperature as exceeding 275° C. employed in the case of PET. If the spinning temperature is lower than 255° C., a smooth spinning cannot be expected due to melt fracture, or others, even though other necessary conditions are satisfied. This is because the spinning temperature is close to the melting point of PTT. If the spinning temperature exceeds 275° C., the heat-decomposition of PTT becomes significant to cause a yarn bending and to generate bubbles, whereby the smooth spinning is disturbed as well as the resultant yarn is poor in physical properties. The spinning temperature is preferably in a range from 255 to 270° C. which is free from both melt fractures and heat-decomposition.

In the fourth aspect, V×[η] is in a range from 5 to 12 (m/min) (dl/g) wherein V is the linear speed of the polymer discharged from the spinneret and represented by the following equation:

$$V(\text{m/min})=4F/\pi\rho R^2$$

wherein F represents a rate (g/min) of the polymer discharged from a single orifice, ρ represents a density (g/cm$^3$) of the polymer and R represents a diameter (mm) of the spinning orifice.

If V×[η] exceeds 12 (m/min)(dl/g), the white-eye phenomenon becomes significant whereby the wiping period must be as short as 48 hours, or 36 hours, or less. Contrarily, if V×[η] is less than 5 (m/min)(dl/g), the evenness of the multifilamentary yarn becomes worse so that the fluctuation value of yarn size (U %) exceeds 1.2%. V×[η] is preferably in a range from 5 to 10 (m/min) (dl/g), more preferably from 5 to 8 (m/min)(dl/min).

In the fourth aspect, the surface temperature of the spinneret is 255° C. or higher. In the case of PTT, it has been found, for the first time and by the, present. inventors that, as the surface temperature of the spinneret becomes lower, the white-eye phenomenon is liable to occur due to the adhesion of polymer on the periphery of the spinning orifice. If the surface temperature of the spinneret is lower than 255° C., the white-eye phenomenon becomes significant to prevent the continuation of the spinning operation. If the surface temperature of the spinneret exceeds the spinning temperature, the surface temperature of each of the plurality of spinnerets may be different from the other. Such a temperature difference causes the variation in dyeability of the resultant multifilamentary yarn. The surface temperature of the spinneretis preferably in a range from 255° C. to the spinning temperature.

Figure 4:
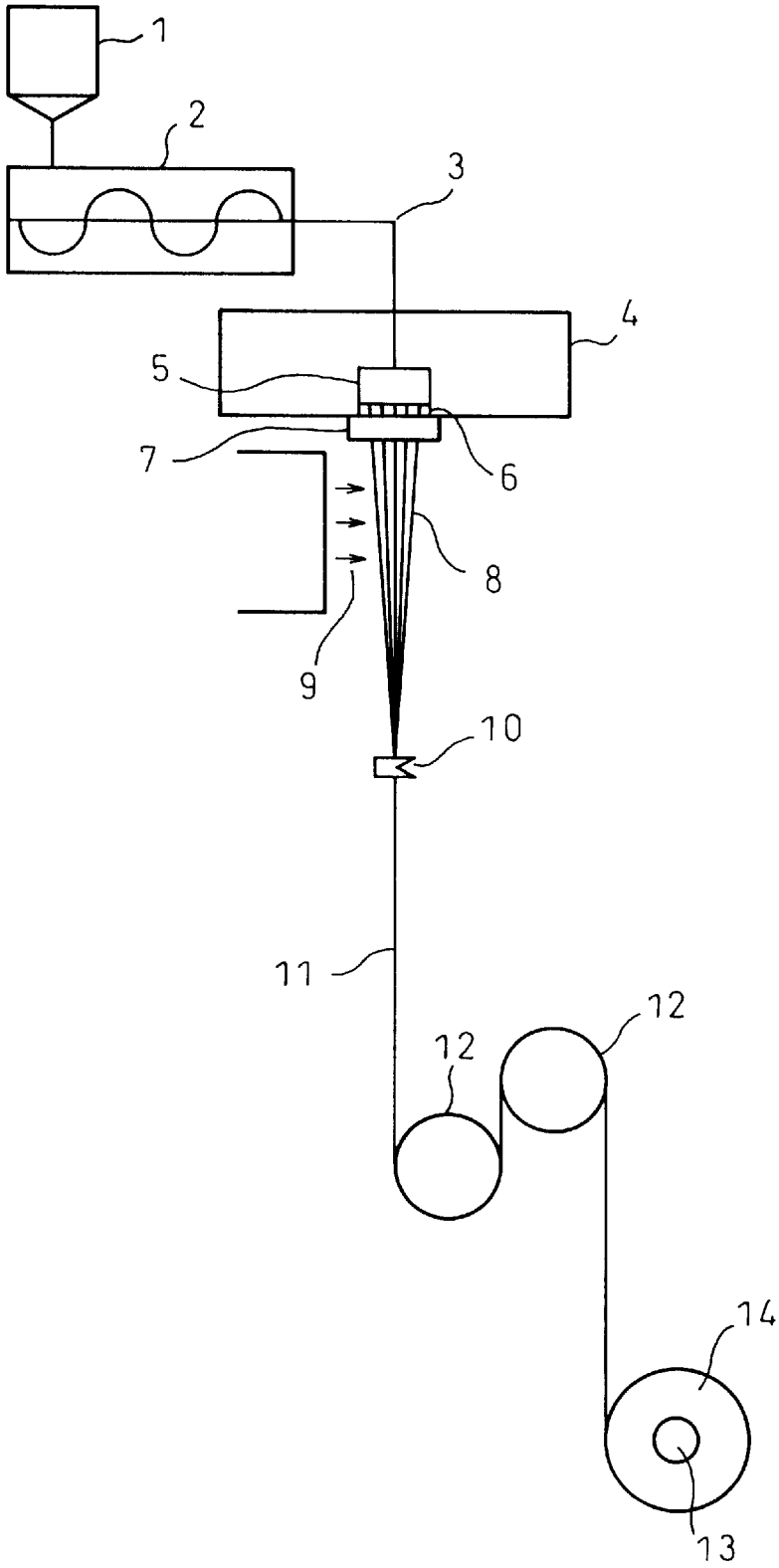
FIG. 4 is a schematic illustration of a spinning machine used for the present invention.

Since a spin pack is usually mounted to the interior of a spin head as is apparent from FIG. 4, the surface temperature of the spinneret varies in relation to the spinning temperature, (the spin head temperature) to be lower by 15 to 20° C. than the latter. To establish the surface temperature of the spinneret in a range of the present invention, it is preferable to use means for positively heating the spinneret and/or the atmosphere immediately beneath the spinneret (such as a spinneret heater 7), if necessary.

In the fourth aspect, a position of a guide or others beneath the spinneret at which the filaments are collected tog ether is preferably in a range satisfying the following equation:

$$13.5\times d+60\leqq \text{a distance between the spinneret and the collecting position (cm)}$$

wherein d represents the filament size (dtex).

Also, a cooling air speed in an area below the spinneret is preferably in a range from 0.6 to 1.2 m/sec.

In the fourth aspect, the spinning speed is not limited. Also, the drawing process may be carried out either after an undrawn yarn has once been taken up or continuously after the spinning.

In the fourth aspect, under the prerequisite that the intrinsic viscosity is in a range from 0.7 to 1.1 dl/g and the filament size is 3.3 dtex or more, it is preferable to determine the spinning speed and to select whether the drawing is carried out or not. Thereby, the multifilamentary yarn defined by the first aspect and the half-drawn yarn defined by the second aspect are furthermore effectively obtainable. That is, the first aspect corresponds to the drawn multifilamentary yarn obtained by drawing the undrawn yarn spun at a spinning speed in a range from 500 to 2500 m/min, while the second aspect corresponds to the half-drawn multifilamentary yarn (POY) obtained by spinning the polymer at a spinning speed exceeding approximately 2500 m/min.

The multifilamentary yarn of the first aspect may be produced either by a two-stage method in which the undrawn yarn is once taken up in a package form and then drawn through a drawing machine, or by a direct spin-draw method in which the spun yarn is continuously drawn prior to be taken up.

One embodiment of a method for producing the inventive PTT multifilamentary yarn (a spinning and low-speed drawing method) will be described below with reference to FIGS. 4 and 5.

First, PTT pellets defined by the present invention are continuously introduced into a polymer drier 1 to dry the pellets with hot air to a moisture content of 30 ppm. The dried pellets are sequentially supplied to an extruder 2 maintained at a temperature in a range from 255 to 265° C. and heated to a temperature exceeding the melting point to be a molten polymer. The molten PTT is supplied via a bend 3 to a spin head 4 maintained at a predetermined temperature, and adjusted to a spinning temperature and filtrated within a spin pack 5. Thereafter, the molten PTT is discharged into a cooling zone through a spinneret 6 mounted within the spin pack 5 to become the multifilamentary yarn. The surface temperature of the spinneret is maintained at a predetermined value by a spinneret heater 7 provided on the periphery of the spinneret. The extruded PTT filaments 8 introduced into a cooling zone are attenuated to a predetermined filament size by the action of godet rolls 12 rotating at a peripheral speed in a range from 1000 to 1900 m/min while being cooled by cooling air 9 to a room temperature, and imparted with a finishing agent by an oiling nozzle 10 to be an undrawn multifilamentary yarn 11. After passing through the godet rolls 12, the undrawn yarn is taken up by a winder 13 to form an undrawn yarn package 14.

Figure 5:
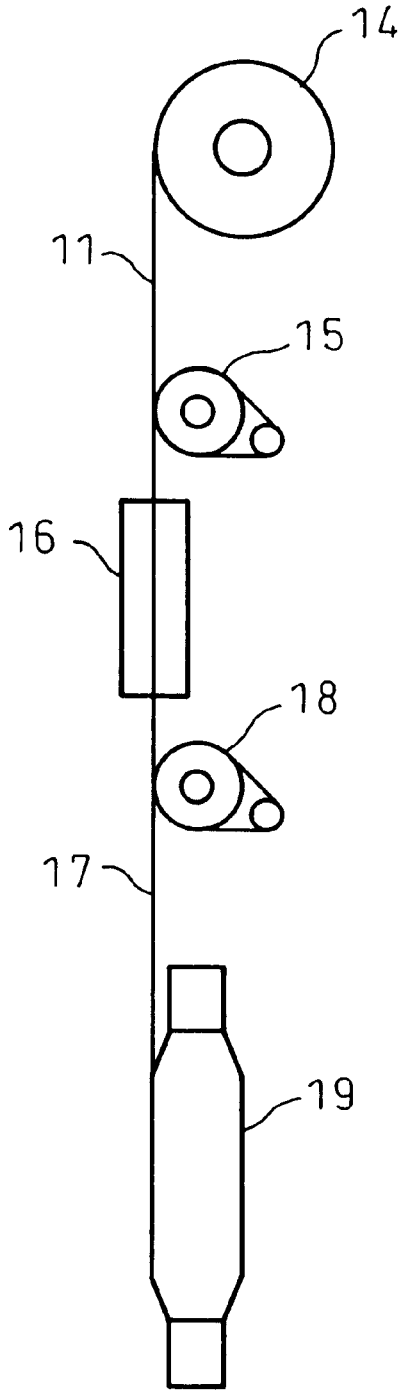
FIG. 5 is a schematic illustration of a drawing machine used for the present invention.

Then, the undrawn yarn package 14 is supplied to a drawing machine shown in FIG. 5. The undrawn yarn 11 is heated to a temperature in a range from 45 to 65° C. by a feed roll 15, and then drawn at a predetermined draw ratio. After being heat-treated by a hot plate 16 maintained at a temperature in a range from 100 to 150° C., a drawn yarn 17 is obtained. The draw ratio is determined by a ratio in speed between the feed roll 15 and a drawing roll 18. The drawn yarn is wound in a pirn form 19 of a twisted yarn or a cheese form (not shown) of a non-twisted yarn, if necessary.

EXAMPLES

The present invention will be further explained below with reference to Examples.

The measurement of the physical properties and the observation of the spinneret surface are as follows:

(a) Intrinsic Viscosity

The intrinsic viscosity [η] is a value defined by the following equation:

$$\text{Intrinsic viscosity } [\eta] = lim(\eta r - 1)/C \quad C \rightarrow 0$$

wherein ηr is a so-called relative viscosity which is a value obtained by dividing a viscosity of a solution of PTT polymer dissolved in o-chlorophenol having a purity of 98% or higher and diluted to a predetermined polymer concentration C (g/100 ml), which viscosity is measured at 35° C., by a viscosity of the solvent measured under the same condition. The relative viscosity is measured at several Cs which are extrapolated to 0 to determine the intrinsic viscosity.

(b) Filament Size

A size of the multifilamentary yarn is measured, which value is divided by the number of filaments of the multifilamentary yarn in accordance with JIS-L-1013.

(c) Elongation at break and elongation when heated to 150° C.

A stress-strain curve is depicted in accordance with JIS-L-1013, from which the elongation at break is obtained. An average of five measured values is defined as the elongation at break of the multifilamentary yarn.

Also, an elongation at break is measured while holding the yarn in a furnace heated at 150° C., which value is defined as the elongation when heated to 150° C.

(d) Fluctuation Value of Yarn Size (U %)

A fluctuation value of yarn size (U %) is measured by using an Uster tester Type 3 (manufactured by Zellweger Co. Ltd.) under the following conditions:

High-pass filter: existing

Measuring speed: 50 m/min

Measuring slot: 3

Measuring time: 5 minutes

Tensional force: 1.25

Tensional pressure: 2.5 bar

Twist: 1500 t/m; S-direction (e) Maximum Crimp Stress and Maximum Crimp Elongation A stress-strain curve of a false-twist textured yarn is measured by the following method under the following conditions:

The false-twist textured yarn is treated in boiling water for 30 minutes and dried. The stress-strain curve is depicted in accordance with JIS-L-1013 (a tensile test) until a full stress reaches 0.882 cN/dtex.

On the stress-strain curve obtained by the above-described method and conditions an intersecting point is determined between a tangent of a curve depicted during an initial process in which the crimps are elongated and a tangent of a curve depicted during a final process in which filaments themselves are stretched. A stress corresponding to this intersecting point divided by a size of the textured yarn is defined as a maximum crimp stress which is a tensile stress of the false-twist textured yarn. Also, an elongation corresponding to this intersecting point is defined as a maximum crimp elongation.

(f) Softness of False-twist Textured Yarn

A tubular knit fabric is prepared from the textured yarn by a single-feed knitting machine, which fabric is classified into the following five grades by experts:

Grade 5: extremely soft

Grade 4: sufficiently soft

Grade 3: scarcely usable for clothing

Grades 2 and 1: hard (not usable for a clothing)

(g) Observation of Polymer Contamination on the Periphery of Spinning Orifice

The contamination is observed by using a telescopic microscope (Type QM-1: manufactured by QUESTAR Co. Ltd.) so that the periphery of the spinning orifice can be seen in an enlarged manner, after 36 hours has lapsed from a time at which the contamination was last wiped off. The result is evaluated in accordance with the following criteria:

◎: Contamination is hardly observed.

○: Contamination is observed in part of the orifice

×: Contamination is observed all over the orifice (h) Stretch-back Property of False-twist Textured Yarn A tubular knit fabric is prepared from the textured yarn by a single-feed knitting machine, which fabric is treated in boiling water for 30 minutes and, after being dried, is subjected to a sensory test by experts in accordance with the following criteria:

◎: Stretch-back property is very good (passed)

○: Stretch-back property is good (passed)

×: Stretch-back property is not good (rejected)

(i) Evaluation of Uneven Dyeing (Dyeing Grade)

A tubular knit fabric is prepared from the drawn yarn by a single-feed knitting machine, which fabric is dyed under the following conditions and subjected to a sensory test by expert's to be classified into ten grades (the larger the numeral, the better the grade) in accordance with criteria samples.

Dyeing Conditions

Dyestuff: Horon Navy S-2GL Gran (phonetic) (O.G., K.K.) of 200%

Concentration of dye: 1.5%

Dispersant: Disper TL (Meisei Kagaku Kogyo K.K.)

Concentration of dispersant: 2 g/l

Bath ratio: 1:18

Dyeing temperature: 97° C.

Dyeing time: 30 minutes

Determination Criteria

Grade 10: there are no dyeing streaks or uneven dyeing (passed)

Grades 8 to 9: there are slight dyeing streaks or uneven dyeing (passed)

Grades 6 to 7: there are somewhat dyeing streaks or uneven dyeing (passed)

Grades 4 to 5: there are many dyeing streaks or uneven dyeing (rejected)

Grades 1 to 3: undrawn portions exist (rejected)

(Grade 6 or higher is a pass)

Examples 1 to 3 and Comparative Examples 1 to 3

Effects of single-filament size of PTT multifilamentary yarn on the stretch-back property, that is, effects of the single-filament size on a stress-strain characteristic (maximum crimp stress) of the false-twist textured yarn, and effects of the single-filament size on the softness were investigated by these Examples and Comparative examples.

PTT multifilamentary yarns of 83.3 dtex/10 filaments (Example 1), 83.3 dtex/12 filaments (Example 2), 83.3 dtex/24 filaments (Example 3), 83.3 dtex/36 filaments (Comparative example 1) and 83.3 dtex/72 filaments (Comparative example 2) consisting of filaments having a circular cross-section were produced from PTT pellets containing titanium oxide of 0.4 wt % and having an intrinsic viscosity of 0.92 dl/g through the spinning machine and the drawing machine (draw-twisting machine) shown in FIGS. 4 and 5 while varying a diameter of a spinning orifice of a spinneret under the following spinning and drawing conditions.

Then, false-twist textured yarn is produced from the resultant yarns under the following conditions:

(1) Spinning Conditions

Moisture content of polymer: 20 ppm

Extrusion temperature (extruder heater temperature): 260° C.

Spinning temperature (spin head temperature): 265° C.

Surface temperature of spinneret: 258° C. (adjusted with a spinneret heater)

Spinneret condition: see Table 1

Polymer extrusion rate: see Table 1

Collection position beneath the spinneret: 170 cm

Cooling air; speed: 0.8 m/sec temperature and humidity: 22° C., 90% RH

Pickup of finishing agent: 0.8 wt %

Spinning speed: 1500 m/min.

Winding speed: 1470 m/min

Temperature and humidity in the vicinity of winder: 22° C., 90% RH (2.) Drawing Conditions Lag time: within 50 hours Temperature and humidity of creel portion: 22° C., 90%. RH Draw ratio: adjusted so that the elongation at break is approximately 45%.

Feed roll temperature: 55° C.

Hot plate temperature: 130° C.

Draw roll temperature: not heated

Draw roll speed (drawing speed): 800 m/min (3) False-twist Texturing Conditions

Type of false-twist texturing machine: Type LS-2 (a pin system) manufactured by MITSUBISHI JUKOGYO K.K Rotational speed of spindle: 27500 rpm Number of false-twists: 3840 t/m First feed ratio: ±0%

First heater temperature (contact type): 160° C.

Second heater temperature (non-contact type): 150° C.

Second feed-ratio: +15%

A drawn yarn of 83.3 dtex/12 filaments was obtained from PET in the same, process as for PTT described above. The false-twist texturing process was carried out by using the same false-twisting texturing machine at the same false-twisting number and the first and second heater temperatures of 220 and 230° C., respectively (Comparative example 3).

Physical properties of yarns (raw yarns) and false-twist textured yarns obtained by Examples 1 to 3 and Comparative examples 1 to 3 are shown in Table 2.

From Table 2, it is apparent that the PTT multifilamentary yarns having a single-filament size in a range from 3.3 to 8.9 dtex (Examples 1 to 3) have a higher maximum crimp stress in comparison with those obtained from Comparative examples 1 and 2 which are out of the above-mentioned range.

In Comparative example 3 in which PET is used, as the false-twist textured yarn was low in maximum crimp stress and poor in fiber stretch recovery while the maximum crimp stress was high, it was small in elongation and inferior in stretch-back property. Also, the touch of PET was harder.

Examples 4 to 6 and Comparative Examples 4 and 5

Effects of the polymer discharge linear-speed from the spinning orifice; i.e., V×[η] on the degree of white-eye phenomenon, that is, on the wiping period, when the intrinsic viscosity of PTT is maintained constant was investigated by these Examples and Comparative examples.

When the multifilamentary yarn of 83.3 dtex/12 filaments was spun, the diameter of the spinning orifice and the polymer discharge linear speed V are variously changed to evaluate the wiping period.

The wiping period was obtained by the following method:

After sixteen un drawn yarns were spun through a spinning machine capable of simultaneously mounting sixteen spinnerets thereon, the sixteen undrawn yarns were subjected to the drawing process for the drawing test through a drawing machine capable of simultaneously drawing a plurality of undrawn yarns.

More specifically, the spinning test was carried out in accordance with a program in which the doffing of undrawn yarn packages of 5 kg weight are repeated twenty times. This was the operation continuing for 60 hours unless the yarn breakage occurs. Subsequently, the drawing test was sequentially carried out while using the doffed undrawn yarn packages. That is, sixteen undrawn yarn packages doffed at the same time were simultaneously fed to the drawing machine and drawn so that two drawn yarn packages of 2.5 kg weight are obtained from the respective undrawn yarn package. The undrawn yarn was maintained under the condition of 22° C. and 90% RH while taking care that the drawing has been completed within 100 hours after the spinning. The yield of the drawing process was obtained by the following equation at every doff:

$$\text{Yield of drawing process (\%)} = 100 \times [16 - (\text{number of yarn-breakage})]/16$$

Also, the wiping period was defined as the maximum time for which the yield of the drawing process is maintained at 81.3% or more.

The spinning orifice-and the extrusion condition used for the test are shown in Table 3. Other conditions than the spinning orifice are the same as in Example 2.

Results of the test are shown in Table 4. As is apparent from Tables 3 and 4, when V×[η] is 12 (m/min)(dl/g) or less (Examples 4 to 6 and Comparative example 5), the wiping period reaches 48 hours or more. In this connection, in Comparative example 5, since V×[η] is less than 5 (m/min)(dl/g), U % exceeds 1.2%.

Examples 4 to 6 in which U % is 1.2% or less has a favorable dyeing grade of 8 to 9. Contrarily, Comparative examples 4 and 5 in which U % exceeds 1.2% has an inferior dyeing grade of 4 to 5.

Examples 7 and 8 and Comparative Example 6

Effects of a distance between the adjacent spinning orifices on the fluctuation value of yarn size (U %) of PTT multifilamentary yarn were investigated by these Examples and Comparative examples.

The spinning and drawing test was carried out in the same manner as in Example 3 except that the distance between the adjacent spinning orifices was varied as shown in Table 5, and resulted in multifilamentary yarns of 83.3 dtex/24 filaments.

Physical properties and the fluctuation value of yarn size (U %) of the resultant multifilamentary yarns are shown in Table 6. As is apparent from Table 6, in Comparative example 6 in which the distance between the adjacent spinning orifices is less than 5 mm, i.e., less than 1.26×d+0.8 mm (d represents a single-filament size in dtex of the drawn yarn), U % exceeds 1.2%.

While Examples 7 and 8 in which U % is 1.2% or less has a favorable dyeing grade of 7 to 8, Comparative example 6, in which U % exceeds 1.2%, has an inferior dyeing grade of 5.

Examples 9 to 12 and Comparative Example 7

The relationship between the elongation at break of the drawn yarn and the processibility thereof in the false-twist texturing process was investigated by these Examples and Comparative example.

Multifilamentary yarns of 83.3 dtex/12 filaments were obtained in the same manner as in Example 2 except for varying the draw ratio and the discharge rate. The resultant elongations at break are shown in Table 7.

24 packages obtained in each of Examples and Comparative example were subjected to the false-twist texturing process through a pin type false-twist texturing machine essentially under the conditions described in Tables 1 to 3 while optimizing the feed ratio in correspondence to the respective conditions. The false-twist texturing process was continuously carried out for 2 days, and the number of yarn breakages per day was counted (in this regard, the number of yarn breakages of 3 ends/day·24 spindles or less is a level which could be adopted in actual production).

As a result, as shown in Table 7, in Examples 9 to 12 in which the elongation at break is 36% or more, the yarn breakage occurs at a low level to enable the continuation of the production. Contrarily, in Comparative example 7 in which the elongation at break is less than 36%, the yarn breakage occurs too often to continue the production.

TABLE 1

| | dtex/filament | polymer discharge rate (g/min) | single-filament size (dtex) | number of spinning orifices | distance between adjacent orifices (mm) | diameter of spinning orifice (mmϕ) | V × [η] (m/min · dl/g) |
|---|---|---|---|---|---|---|---|
| Example 1 (PTT) | 83.3/10 | 29.5 | 8.3 | 10 | 11 | 0.60 | 8.4 |
| Example 2 (PTT) | 83.3/12 | 29.5 | 6.9 | 12 | 10 | 0.50 | 10.0 |
| Example 3 (PTT) | 83.3/24 | 27.5 | 3.5 | 24 | 8 | 0.40 | 7.2 |
| Comparative example 1 (PTT) | 83.3/36 | 27.5 | 2.3 | 36 | 6 | 0.23 | 14.5 |
| Comparative example 2 (PTT) | 83.3/72 | 26.8 | 1.2 | 72 | 4 | 0.23 | 7.2 |
| Comparative example 3 (PET) | 83.3/12 | 35.0 | 6.9 | 12 | 10 | 0.30 | 20.4 |

TABLE 2

| | | physical property of raw yarn | | | | physical property of false-twist textured yarn | | | |
|---|---|---|---|---|---|---|---|---|---|
| | Yarn dtex/f | single-filament size (dtex) | strength at break (cN/dtex) | elongation at break (%) | variance of yarn size U % (%) | maximum crimp elongation (%) | maximum crimp stress (cN/dtex) | stretch-back property | softness |
| Example 1 | PTT 83.3/10 | 8.3 | 3.3 | 44 | 0.8 | 175 | 0.031 | ⊙ | 3 |
| Example 2 | PTT 83.3/12 | 6.9 | 3.2 | 45 | 0.9 | 169 | 0.028 | ⊙ | 3 |
| Example 3 | PTT 83.3/24 | 3.5 | 3.2 | 44 | 1 | 173 | 0.022 | ○ | 4 |
| Comparative example 1 | PTT 83.3/36 | 2.3 | 3.3 | 43 | 1.2 | 163 | 0.017 | X | 4 |
| Comparative example 2 | PTT 83.3/72 | 1.2 | 3.1 | 46 | 1.5 | 150 | 0.010 | X | 5 |
| Comparative example 3 | PET 83.3/12 | 6.9 | 3.8 | 29 | 1.3 | 115 | 0.035 | X | 2 |

TABLE 3

| | dtex/filament | single-filament size (dtex) | number of spinning orifices | distance between adjacent orifices (mm) | diameter of spinning orifice (mmϕ) | V × [η] (m/min · dl/g) |
|---|---|---|---|---|---|---|
| Example 4 | 83.3/12 | 6.9 | 12 | 10 | 0.70 | 5.1 |
| Example 5 | 83.3/12 | 6.9 | 12 | 10 | 0.60 | 7.0 |
| Example 6 | 83.3/12 | 6.9 | 12 | 10 | 0.50 | 10.1 |
| Comparative example 4 | 83.3/12 | 6.9 | 12 | 10 | 0.40 | 15.6 |
| Comparative example 5 | 83.3/12 | 6.9 | 12 | 10 | 0.80 | 4.2 |

TABLE 4

| | strength at break (cN/dtex) | elongation at break (%) | fluctuation value of yarn size (U %) (%) | wiping period (Hr) | contamination of spinneret (36 Hr after) | dyeing grade (grade) |
|---|---|---|---|---|---|---|
| Example 4 | 3.5 | 43 | 0.8 | 56 | ◎ | 9 |
| Example 5 | 3.4 | 45 | 0.8 | 56 | ◎ | 9 |
| Example 6 | 3.6 | 44 | 1 | 48 | ○ | 8 |
| Comparative example 4 | 3.3 | 45 | 1.3 | 36 | X | 5 |
| Comparative example 5 | 3.4 | 45 | 1.5 | 50 | ◎ | 4 |

TABLE 5

| | dtex/filament | single-filament size (dtex) | number of spinning orifices | distance between adjacent orifices (mm) | diameter of spinning orifice (mmϕ) | V × [η] (m/min · dl/g) |
|---|---|---|---|---|---|---|
| Example 7 | 83.3/24 | 3.3 | 24 | 6 | 0.40 | 7.3 |
| Example 8 | 83.3/24 | 3.3 | 24 | 5 | 0.40 | 7.3 |
| Comparative example 6 | 83.3/24 | 3.3 | 24 | 4 | 0.40 | 7.3 |

TABLE 6

| | yarn size (dtex) | strength at break (cN/dtex) | elongation at break (%) | fluctuation value of yarn size U % (%) | dyeing grade (grade) |
|---|---|---|---|---|---|
| Example 7 | 83.6 | 3.6 | 44.0 | 1.0 | 8 |
| Example 8 | 84.0 | 3.5 | 45.3 | 1.2 | 7 |
| Comparative example 6 | 83.3 | 3.4 | 46.1 | 1.4 | 5 |

TABLE 7

| | elongation at break (%) | elongation at 150° C. (%) | number of yarn breakage during false-twist texturing process (end/day · 24 sp) |
|---|---|---|---|
| Example 9 | 38.0 | 26.5 | 2.5 |
| Example 10 | 43.5 | 31.3 | 1.5 |
| Example 11 | 49.2 | 36.8 | 1.0 |
| Example 12 | 56.0 | 43.0 | 0.5 |
| Comparative example 7 | 34.3 | 22.0 | 8.0 |

CAPABILITY OF EXPLOITATION IN INDUSTRY

A false-twist textured yarn having a feeling of touch peculiar to PTT and excellent stretch property is obtainable in a stable manner from the inventive PTT multifilamentary yarn and half-drawn yarn, which is evenly dyeable and free from the generation of yarn breakage or fluff during the post treatment. The false twist textured yarn obtained from the inventive PTT yarn and half-drawn yarn is suitable for a stretch clothing and capable of constituting a novel stretch clothing field.

According to the inventive method for producing PTT multifilamentary yarn, the generation of white-eye phenomenon in the vicinity of the spinning orifice is reduced to a large extent, and the wiping period of the spinneret can be prolonged to as long as 48 hours or more even if the yarn having a single-filament size of 3.3 to 8.9 dtex, which is problematic in the prior art, is spun. The resultant PTT multifilamentary yarn is evenly dyeable and free from the generation of yarn breakage or fluff in the post treatment such as a false-twist texturing process.

What is claimed is:

1. A polytrimethylene terephthalate multifilamentary yarn formed of single filaments, having a circular cross-section, of polytrimethylene terephthalate composed of 95 mol % or more of trimethylene terephthalate repeating units and 5 mol % or less of other ester repeating units, characterized in that the multifilamentary yarn satisfies the following conditions (1) to (4):

(1) An intrinsic viscosity in a range from 0.7 to 1.1 dl/g (2) A single-filament size in a range from 3.3 to 8.9 dtex (3) An elongation at break in a range from 36 to 60%, and (4) A fluctuation value of yarn size (U %) of 1.2% or less.

2. A false-twist textured polytrimethylene terephthalate yarn characterized in that the false-twist textured yarn is produced by false-twist texturing or draw false-twist texturing the polytrimethylene terephthalate multifilamentary yarn defined by claim 1.

3. A half-drawn polytrimethylene terephthalate multifilamentary yarn formed of single filaments, having a circular cross-section, of polytrimethylene terephthalate composed of 95 mol % or more of trimethylene terephthalate repeating units and 5 mol % or less of other ester repeating units, characterized in that the multifilamentary yarn satisfies the following conditions (1) to (4):

(1) An intrinsic viscosity in a range from 0.7 to 1.1 dl/g (2) A single-filament size in a range from 3.9 to 13.3 dtex (3) An elongation at break in a range from 61 to 120%, and (4) A fluctuation value of yarn size (U %) of 1.2% or less.

4. A false-twist textured polytrimethylene terephthalate yarn characterized in that the false-twist textured yarn is produced by false-twist texturing or draw false-twist texturing the half-drawn polytrimethylene terephthalate multifilamentary yarn defined by claim 3.

5. A method for producing a polytrimethylene terephthalate multifilamentary yarn or half-drawn multifilamentary yarn formed of single filaments, having a circular cross-section and an intrinsic viscosity [η] in a range from 0.7 to 1.3 dl/g, of polytrimethylene terephthalate composed of 95 mol % or more of trimethylene terephthalate repeating units and 5 mol % or less of other ester repeating units, characterized in that the multifilamentary yarn is produced under the following conditions (1) to (4):

(1) A distance between the adjacent spinning orifices is 5 mm or more (2) A spinning temperature is in a range from 255 to 275° C.

(3) A surface temperature of a spinneret is 255° C. or higher (4) $V \times [\eta]$ is in a range from 5 to 12 (m/min)(dl/g)

wherein V represents a linear discharge speed (m/min) of melted polytrimethylene terephthalate.

6. A method for producing a polytrimethylene terephthalate multifilamentary yarn or half-drawn multifilamentary yarn as defined by claim 5, characterized in that a distance between the adjacent spinning orifices satisfies the following condition:

$$1.26 \times d + 0.8 \text{ (mm)} \leqq \text{distance between adjacent spinning orifices} \leqq 20 \text{ (mm)}$$

wherein d represents a single-filament size (dtex) of the drawn yarn or half-drawn yarn.

7. A method for producing a polytrimethylene terephthalate multifilamentary yarn or half-drawn multifilamentary yarn as defined by claim 5 or 6, characterized in that the intrinsic viscosity is in a range from 0.7 to 1.1 dl/g and the single-filament size is 3.3 dtex or more.

* * * * *